United States Patent [19]

Kennepohl et al.

[11] 4,135,022

[45] Jan. 16, 1979

[54] BUILT-UP ROOFING USING SULFUR ASPHALT

[75] Inventors: Gerhard J. A. Kennepohl, Oakville; Laverne J. Miller, Georgetown; David C. Bean, Oakville, all of Canada

[73] Assignee: Gulf Canada Limited, Toronto, Canada

[21] Appl. No.: 620,472

[22] Filed: Oct. 7, 1975

[51] Int. Cl.[2] ..... B32B 11/10; B32B 11/02

[52] U.S. Cl. ..... 428/143; 106/274; 428/141; 428/281; 428/291; 428/323; 428/489; 428/920; 428/921; 106/287.32

[58] Field of Search ..... 461/141, 281, 143, 291, 461/489, 282, 920, 921; 52/518; 106/287 SC, 274, 275, 247, 278; 428/323, 491

[56] References Cited

U.S. PATENT DOCUMENTS

| | | | |
|---|---|---|---|
| 256,368 | 4/1882 | Poschel | 428/491 |
| 1,026,855 | 5/1912 | Ellis | 428/491 |
| 2,326,724 | 8/1943 | Fasold et al. | 428/920 |
| 2,490,430 | 12/1949 | Greider et al. | 428/920 |
| 3,096,196 | 7/1963 | Bettoli | 428/143 |
| 3,721,578 | 3/1973 | Bennett et al. | 428/489 |
| 3,769,078 | 10/1973 | Roth et al. | 428/920 |

*Primary Examiner*—George F. Lesmes
*Assistant Examiner*—P. Thibodeau
*Attorney, Agent, or Firm*—D. R. Morrison

[57] ABSTRACT

The disclosure describes built-up roofing having improved resistance to spreading of fire, fabricated from two or more layers of felt impregnated with asphalt based saturant with asphalt based coating spread on top of each felt layer; the saturant asphalt or coating asphalt or both are blends of 90 - 45% asphalt with 10 - 55% sulfur. The roofing is built-up in the conventional manner by "mopping" fluid asphalt based coating onto felt layers impregnated with asphalt based impregnant. A protective layer of inert mineral aggregate (e.g. gravel) optionally covers the top coating.

5 Claims, No Drawings

BUILT-UP ROOFING USING SULFUR ASPHALT

This invention relates to roofing for flat or low pitched roofs, more specifically the type known as "built-up roofing" (referred to briefly as BUR), which comprises a substantially rigid deck covered with multiple layers of asphalt impregnated felt having a separately applied coating of asphalt on top of each layer of felt; such roofs frequently also have a protective layer of small stones or other inert mineral aggregate material, sized for example in the range from 2 mm to 20 mm, embedded in and covering the top asphalt coating.

Built-up roofing is used primarily on commercial buildings, and is used to the substantial exclusion of other roofing types on large industrial buildings of low profile. Its popularity arises from its relatively low cost combined with its effectiveness as a weather repellant surface and its durability. The major drawback in its use is performance under the unfortunate circumstances when it is subject to fire. Because any fire tends to spread most rapidly in an upward direction, fires in low profile buildings tend quickly to attack the building roof. Thus a persistent fire in a local area of a large low profile building soon spreads to the roof where, on built-up roofing, it can spread laterally. Lateral spreading of fire in the roof would not in itself be serious, as it generally does not seriously damage the frame or contents of the building. However the asphalt layers of built-up roofing are not only combustible, they liquify with the heat of the fire and tend to drip burning liquid asphalt onto building parts or contents below, thus spreading laterally within a building even an initially localized fire. Such hazard is most dramatically illustrated by the disastrous fire in the General Motors plant in Livonia, Mich., which occurred on Aug. 12, 1953, and destroyed an entire single story plant area of 34.5 acres under one roof. The National Fire Protection Association Quarterly, October 1953, in reviewing the fire commented:

"The flat roof . . . had much to do with the spread of the fire . . . Fire caused by sparks from an oxy-acetylene cutting torch broke out in a conveyor drip pan . . . the oil condensate on steel roof members ignited, adding fuel to heat the roof deck . . . and soon hot tar and asphalt were flowing through cracks between strips in the heat warped roof deck and igniting. The fire then spread laterally behind the increasing area of melted tar that oozed through the roof and simultaneously several fires broke out on machinery, in flammable liquid containers, and on the wood floor as hot tar dropped down. As fire fighters ran for safety, many were burned by hot drops of tar, and three were trapped and killed . . . Had evacuation been delayed until the building became untenable due to heat, smoke and falling drops of burning tar and asphalt, there undoubtedly would have been a much longer list of casualties".

This major fault or imperfection is the use of built-up roofing has now been substantially overcome by the present invention.

The invention consists of an asphalt based built-up roofing structure having a substantially rigid deck covered with multiple layers of felt impregnated with an asphalt based saturant, and a separately applied asphalt based coating on top of each layer of felt, with at least one of, and preferably both, said saturant and said coatings being a blend of from 10% to 55% sulfur dispersed in 90% to 45% by weight of asphalt. The invention also includes an asphalt based built-up roofing structure as defined above and having a protective layer of inert mineral aggregate material imbedded in the top coating. The proportions and percentages referred to throughout this specification and appended claims are proportions and percentages by weight unless otherwise specifically noted herein.

There are disclosed in our copending patent application Ser. No. 620,473, filed concurrently herewith, and now U.S. Pat. No. 4,079,158, asphalt roofing shingles comprising a felt backing saturated with an asphalt based saturant and a mineral filler binder mixture coated thereon, the binder being a uniform sulfur asphalt dispersed composition containing from 10% to 55% by weight of sulfur dispersed in 90% to 45% coating asphalt; it is also disclosed in said application that the foregoing shingles have superior fire retarding properties and little or no run-off of liquid asphalt from the shingle edges when the shingles are mounted at a 45 degree angle, ignited, and burned. In the preferred shingles disclosed in said application, the asphalt based saturant in the felt backing is a uniform dispersed composition of from 10% to 55% sulfur dispersed in 90% to 45% saturant asphalt. In the preferred forms of the present invention likewise, the asphalt based saturant impregnating the felt is a uniform dispersed composition of from 10% to 55% sulfur dispersed in 90% to 45% saturant asphalt. Preferably the sulfur dispersed in any asphalt in the present invention comprises from 20% to 40% by weight of the blend, and sulfur in the blend which is not dissolved therein is dispersed as finely divided particles in the size range below substantially 50 microns.

Built-up roofing is conventionally constructed by (1) applying multiple layers of parallel strips of asphalt impregnated felt in succession onto a rigid roof base, with appropriate overlapping at the joints between adjacent parallel strips used to form a single layer from rolls of the felt, and (2) covering each layer of felt in succession with a coating of an appropriate grade of fluid hot asphalt onto which coating the succeeding layer of felt is applied and adhered before the hot asphalt has cooled to solid form. When the rigid deck for the roofing is a wooden material, for example plywood, it is customary to fasten the bottom layer of felt to the deck with suitable nails. When the deck is concrete, gypsum board, or other material unsuitable for nailing, a bottom coating of primer asphalt is applied thereto to fasten the bottom felt layer to the deck. The entire operation of coating a felt layer or the deck with asphalt and covering the coating with another layer of felt must be carried out rapidly so that each layer of felt is applied to an asphalt coating while the latter is still sufficiently hot and adherent to ensure firm adhesion of the upper felt to the asphalt below. The top layer of felt receives a final coating of asphalt which optionally is protected by a layer of loose aggregate imbedded in and covering the asphalt.

The selection of the grade of asphalt to be used in constructing a built-up roof depends upon a number of factors including primarily the pitch of the roof and the temperature range in the climate to which the roof is to be exposed. The grade of an asphalt is characteristic of course of a combination of its physical properties. The most significant of these properties for this purpose is the softening point. The greater the pitch on a roof, or the higher the temperatures to which the roof will be subjected, the higher the softening point required for the asphalt. The addition of a proportion of sulfur in the asphalt blends used in the present invention does not significantly change this property of the asphalt; generally the sulfur lowers the softening point slightly, but occasionally with some asphalts some proportions of sulfur raise the softening point of the blend slightly.

In contrast, the presence of sulfur in the sulfur asphalt blends used in the present invention does significantly change the viscosity of the blends in the fluid state as compared to the viscosity of the asphalt alone at the same temperature. The viscosity of fluid blends of sulfur and asphalt as used in the present invention is considerably lower than that of the asphalt of the blend alone at temperatures above the melting point of sulfur, and as a result, the fluid blends do not have to be at as high a temperature as fluid asphalt itself when being applied to construct built-up roofing. Thus it is possible, convenient, and preferable to have the fluid blends of sulfur and asphalt at temperatures at least substantially 50° F. (30° C.) cooler than the temperatures to which asphalt alone is heated for application in built-up roofing. This differential is based primarily on the difference in temperature between a fluid asphalt of a specified viscosity and the lower temperature of a fluid blend of the same asphalt blended with sulfur in a proportion of substantially 25% sulfur, 75% asphalt and having substantially the same specified viscosity at said lower temperature. This difference in viscosity of fluid sulfur asphalt blends permits the mopping of the blends onto roofs in the construction of built-up roofing at temperatures better suited to the avoidance of pollutant and noxious vapors that can develop in the sulfur asphalt blends at the higher temperatures which generally are required for mopping regular asphalt. Thus the built-up roofing structures are constructed in the conventional way in which asphalt based built-up roofing structures of the prior art have been built, except that the roofing asphalt based coating which is applied to felt in constructing the roofing, and optionally the asphalt based saturant in the impregnated felt, are blends of from 10% to 55% of sulfur dispersed in 90% to 45% of the appropriate asphalt. Preferably such blends have from 20% to 40% of sulfur dispersed in the asphalt, and no dispersed sulfur particles in the blend exceed 50 microns in diameter, most preferably averaging from one to ten microns.

As described in the aforementioned copending application, the admixture of elemental sulfur with roofing grades and similar grades of asphalt is readily achieved by blending sulfur in liquid form into the asphalt in fluid form, in the desired proportions at temperatures not over substantially 350° F. (176° C.) and under conditions of adequate shear whereby the sulfur becomes dispersed in the asphalt; adequate shear can be achieved with high speed stirrers, propeller mixers, pipeline mixers, and other high shear mixing equipment of conventional design appropriately sized for the quantity of material to be mixed. It is known in the art that sulfur, dispersed in asphalts in this manner, dissolves in and/or otherwise combines homogeneously with asphalt up to a proportion between substantially 15% and 25% by weight of the mixture. The proportion that can be thus homogeneously dispersed depends primarily upon the nature of the asphalt. When larger proportions of liquid sulfur are blended with fluid asphalt, the excess above the proportion that is homogeneously dispersed becomes heterogeneously dispersed as fine droplets of liquid sulfur in the fluid asphalt, up to a total in the range between substantially 50% and 60% by weight of total sulfur in the mixture, above which the mixture tends to invert and become a dispersion of fluid asphalt in liquid sulfur. Hence proportions of sulfur above substantially 55% by weight of the total of sulfur and asphalt are unsuitable for and excluded from this invention. On cooling the heterogeneous dispersions of liquid sulfur droplets in fluid asphalt the sulfur solidifiers or crystalizes and remains dispersed as small particles dispersed in the asphalt.

The following example is given to compare the burning and fire spreading properties of laboratory samples of simulated built-up roofing containing no dispersed sulfur, in the saturant and roofing asphalts therein, with samples containing 25 parts sulfur per 75 parts asphalt in the saturant and roofing asphalts used to make the samples. The laboratory samples of simulated built-up roofing were prepared by the following series of steps:

(1) impregnating a sheet of dry unsaturated paper felt 0.019 inches (0.48 mm) thick with saturant by hand dipping the felt into the saturant at 300° F. (149° C.) for about 45 seconds to simulate passage of a continuous web of the felt over rollers through a dip tank, allowing the sheet to drip 15 seconds, then squeezing it between sheets of silicone coated quick release paper in the heated platens of an hydraulic press held in the temperature range 220°-250° F. (104°-121° C.) to squeeze out excess saturant and leave the saturated sheet containing substantially 170%, based on its original dry weight, of saturant.

(2) annealing two such impregnated sheets into a single sheet by pressing them together in the hydraulic press to form a saturated felt sheet 0.040 inches (1.0 mm) thick.

(3) covering the top surface of the foregoing sheet with a coating of roofing asphalt or sulfur asphalt blend and leveling the coating by pressing the coated sheet, between covers of silicone coated quick release paper, in the jaws of the hydraulic press with metal spacers at each side of the sheet to control thickness of the coating.

(4) heating the top surface of the coated sheet with a small heat source to soften the asphalt and laminating an identically coated sheet to the softened asphalt by pressing the two together for a few seconds under slight pressure between the press jaws, to obtain a laminated, or "built-up", structure of substantially 0.11 inches (2.8 mm) thickness.

(5) calipering the laminated structure to select a 3 by 10 inch (7.6 by 25.4 cm) section of uniform thickness and cutting out the section to constitute the sample of simulated built-up roofing.

Five sets of duplicate built-up roofing test samples were prepared in the foregoing manner, the five sets differing in the composition of the saturant in the felt or of the coating, as follows:

1. This set contained felt impregnated with a commercial felt saturant asphalt sold as "420 Saturant" (trademark) having the following physical properties:

Specific gravity, 60° F. (15.6° C.)— 1.0209
Softening point (ASTM D36)— 149° F. (65° C.)
Penetration at 77° F. (25° C.) (ASTM D5)— 35
Ductility at 77° F. (25° C.) (ASTM D113)— 11cm The coating on the impregnated felt was a commercial roofing asphalt sold as "BUR 3 Roofing Compound" having the following physical properties:

API Gravity at 60° F. (15.6° C.)— 5.8
Specific Gravity at 60° F. (15.6° C.)— 1.0306
Softening point (ASTM D36)— 200° F. (93.3° C.)
Penetration at 77° F. (25° C.) (ASTM D5)— 15
Ductility at 77° F. (25° C.) (ASTM D113)— 3.2 cm 2. The second set contained felt impregnated with a saturant blend of 75% saturant asphalt of the grade used in preceding set and 25% of liquid sulfur dispersed therein, the dispersed sulfur droplets not exceeding 50 microns in diameter; the coating on the felt was the same "BUR 3 Roofing Compound" used in the preceding set.
3. The third set contained felt with the same saturant material used in the first set, and the coating thereon was a blend of 75% of BUR 3 Roofing Compound described above and 25% of liquid sulfur dispersed therein, the dispersed sulfur droplets not exceeding 50 microns in diameter.
4. The fourth set contained felt impregnated with the same sulfur asphalt blend used in the second set and coated with the same sulfur asphalt blend coated on the felt in the third set, i.e. the saturant and coating asphalts each were blends containing 25% liquid sulfur dispersed therein.
5. The last set contained a commercial impregnated felt saturated with saturant asphalt of unspecified properties and coated with the sulfur asphalt blend used in the third set; the commercial felt was 0.035 inches (0.89 mm) thick and the saturant therein was not identifiable other than being a commercial saturant.

EXAMPLE

The combustion properties of the foregoing five sets of test samples were compared by a modified burning test like the one used in the aforementioned copending application. For the test used for the present invention, frames were constructed in the form of a rectangular inverted "U", using ⅛ inch (3.2 mm) thick brass with sides ½ inch (13 mm) wide. A distance of 2 inches (51 mm) clear space between the inside of the sides of the frames was maintained, with 10 inches (254 mm) clear space from the bottom to inside the top of the inverted "U". Two frames were clamped, one each side, to a 3 by 10 inch (76 mm by 254 mm) test sample to form a flat test piece having an exposed edge; this test piece was held with the frame firmly mounted at an angle of 20° to the horizontal and with the exposed edge at the bottom. To provide a uniform source of ignition, the taper from a standard Cleveland Open Cup flash apparatus was used. The flame of the taper was adjusted to a length of 3 inches (7.6 cm) and the tip of the taper placed 2 inches (5 cm) from the surface of the test piece, ½ inch (13 mm) from the lower edge, so that the flame played onto the surface of the felt for about an inch (2.5 cm) for a period of 60 seconds to ensure ignition, after which the flame was removed. Each sample of material to be ignited was weighed before burning and the residue of char, ash, and unburned part of the sample weighed after self extinction to determine the weight loss of the sample during combustion. It should be noted that inasmuch as one third of the sample weight was inaccessible for combustion, being clamped between the side pieces so that air necessary for combustion could not reach it, only two thirds of each sample at most could be consumed by combustion. Additionally, the fluid asphalt that softened, flowed, and dripped from each sample during ignition and combustion was collected in a drip pan and weighed to determine the weight loss, as a percentage of the consumable sample weight, that was lost simply as "run-off" of fluid asphalt. The losses in weight that occurred for each set of test samples, averaging the results of the duplicates of each test, expressed as a percentage of the consumable weight of the sample, are given in the folloing Table 1, in which column 1 identifies the test set in the group of test samples described above, columns 2 and 3 list the proportions of added sulfur in the saturant and coating asphalts of the test pieces, column 4 lists the weight loss of the samples due to run-off of asphalt or sulfur asphalt blend during combustion, and column 5 lists the total weight loss of the sample that occurred during ignition and combustion of the sample until the flame thereof self-extinguished, both the foregoing losses being expressed as a percentage of the weight of the original sample that could be consumed by combustion.

TABLE 1

| Test Set No. | Added Sulfur In Saturant | Added Sulfur In Coating | Run Off (Wt. %) | Total Loss (Wt. %) |
|---|---|---|---|---|
| 1 | 0 | 0 | 35 | 77 |
| 2 | 25% | 0 | 1.6 | 2.6 |
| 3 | 0 | 25% | 1.8 | 2.3 |
| 4 | 25% | 25% | 0.7 | 1.4 |
| 5 | 0 | 25% | 1.1 | 1.6 |

In addition to the foregoing quantitative data it can be noted qualitatively that the first set of test pieces, containing no added sulfur in either the saturant of the felt or the superposed asphalt coatings, self extinguished only when the ignited flame had burned all the way from the bottom to the top of the sample. During ignition and combustion of the test pieces of this first set, asphalt which had become fluid in front of the combustion flame ran down the surface to the bottom edge where, following its ignition on passing through the flame, it heated and ignited the bottom edge of the test pieces as well as dripping off the edge of the test pieces. As a result of this application of heat to the bottom edge of these test pieces, combustion continued from the bottom to the edge of the pieces after removal of the taper flame. In contrast, with all the other test pieces, in which there was added sulfur in the saturant asphalt, coating asphalt, or both, there was very little flow of fluid asphalt down the top surface of the test pieces through the flame, the intumescent charring that occurred in the path of the flame largely precluded fluid asphalt from running to the bottom edge. Consequently there was only a minor amount of asphalt run-off from these samples and in each case there was insufficient heat developed on the test pieces to sustain combustion; the combustion flames on these pieces all died out within a few seconds of the removal of the igniting taper.

As an additional comparison it can also be noted that further samples were prepared in the same way as sets 2, 3, and 5 in the foregoing Example, then ignited and re-ignited repeatedly by re-application of the taper for 60 second intervals until the samples had burned to the top edge and no longer ignited on application of the taper; these samples, despite having burned to the end, lost only from one-third to one-half of their consumable weight on burning and the run-off averaged less than ten percent of the consumable weight. Thus not only do the sulfur asphalt blends increase the burning resistance of the roofing material in which they are used, when compared to ordinary asphalts, they also remarkably reduce the run-off of fluid combustible material that occurs during combustion of the roofing material. This is an entirely unexpected result when one considers the known fact that fluid mixtures of sulfur and asphalt at temperatures above the melting point of sulfur have lower viscosities than the corresponding asphalts alone at the same temperature, and thus would be expected to run and drip more readily and extensively from burning built-up roofing than would the corresponding ordinary asphalt.

While the example herein has illustrated a built-up roofing structure having only two plies of felt each covered with asphalt, the minimum required for a built-up roof system, it will be obvious that three or more plies can also be used in the roofing structures of the present invention. Likewise the proportion of sulfur in the asphalt blends used in saturating or coating the felt plies can range from 10% to 55% as previously indicated, with proportions from 20% to 40% preferred. The felt plies can be plies of paper felt, rag felt, asbestos fibre felt, or felted or woven fiberglass, all suitably impregnated with asphalt based saturant. Numerous other modifications of the expedients described herein can be made without departing from the scope of the invention which is defined in the following claims.

We claim:

1. An asphalt based built-up roofing structure having a substantially rigid deck covered with multiple layers of felt impregnated with an asphalt based saturant, and a separately applied asphalt based coating on top of each layer of felt, the bottom felt layer being fastened to said rigid deck, each superposed impregnated felt layer also being firmly adhered to the asphalt based coating applied to the felt layer thereunder and with at least one of said saturant and said coatings consisting of a uniform blend of from 10% to 55% sulfur dispersed in 90% to 45% by weight of asphalt, with any of the sulfur which does not dissolve in the asphalt being dispersed as finely divided particles in the size range below substantially 50 microns.

2. A built-up roofing structure as claimed in claim 1 in which both the asphalt based saturant and the asphalt based coatings are blends of from 10% to 55% sulfur dispersed in 90% to 45% of asphalt.

3. A built-up roofing structure as claimed in claim 2 in which the saturant and coatings are blends of from 20% to 40% sulfur dispersed in 80% to 60% of asphalt.

4. A built-up roofing structure as claimed in claim 3, additionally having a protective layer of inert mineral aggregate material imbedded in the top coating.

5. A built-up roofing structure as claimed in claim 4 in which the dispersed sulfur particle size averages from one to ten microns.

* * * * *